United States Patent [19]

Gritsuk et al.

[11] Patent Number: 4,559,011

[45] Date of Patent: Dec. 17, 1985

[54] COOLING ARRANGEMENT FOR SHAFT FURNACES

[75] Inventors: Lev D. Gritsuk; Anatoly S. Gorbik; Leonid D. Golod; Dorina B. Kutsykovich; Kazimir D. Bashinsky; Sergei V. Samofal, all of Kharkov; Igor M. Peftiev; Viktor P. Bogoditsa, both of Donetskaya; Alexandr N. Kulagin, Donetskaya; Gennady E. Goryainov; Jury G. Bannikov, both of Kharkov; Semen M. Liderman, Kharkov; Georgy V. Nikolaev, Kharkov; Vitaly N. Mischenko, Kharkov; Valentin V. Gromenko, Kharkov; Alexei M. Kamardin; Nikolai S. Kobets, both of Donetsk, all of U.S.S.R.

[73] Assignee: Vsesojuzny Nauchno-Issledovatelsky I Proektny Institut Pozovaniju Vtorichnykh Energoresursov Predpriyaty Chernoi Metallurgii "Vnipichermetenergoochistka", Kharkov, U.S.S.R.

[21] Appl. No.: 576,397

[22] PCT Filed: May 27, 1982

[86] PCT No.: PCT/SU82/00017

§ 371 Date: Jan. 16, 1984

§ 102(e) Date: Jan. 16, 1984

[87] PCT Pub. No.: WO83/04266

PCT Pub. Date: Dec. 8, 1983

[51] Int. Cl.[4] ..... F27D 1/12; F27D 15/02; F22B 37/00; C21B 7/10

[52] U.S. Cl. ..... 432/233; 122/6 B; 266/193; 432/77

[58] Field of Search ..... 432/77, 79, 233; 266/193, 194, 197; 122/6 R, 6 A, 6 B

[56] References Cited

U.S. PATENT DOCUMENTS 3,687,434 8/1972 Dyskin et al. ..... 432/233

FOREIGN PATENT DOCUMENTS 2924991 1/1981 Fed. Rep. of Germany ..... 432/233
0662586 5/1979 U.S.S.R. ..... 266/197

*Primary Examiner*—John J. Camby
*Attorney, Agent, or Firm*—Lilling & Greenspan

[57] ABSTRACT

The cooling arrangement comprises spaced apart cooling tubes arranged in a frame and interconnected with metallic tie plates. For decreasing thermal stresses without loss of strength throughout the structure, each tie plate is tangentially welded with its edge portions to the adjacent cooling tubes on both the shell and the furnace sides thereof. Each tie plate may be tangentially welded to one adjacent cooling tube and to the other it may be welded on the portion of its surface defined by an arc between tangents to this arc from the location where the tie plate is tangentially welded. The cooling tubes and the tie plates may be provided with fins and, the tie plates and the fins and as well as the walls of the frame have expansion clearances or slots. The frame is filled with a refractory material serving to protect the whole cooling arrangement.

14 Claims, 10 Drawing Figures

COOLING ARRANGEMENT FOR SHAFT FURNACES

BACKGROUND OF THE INVENTION

The present invention relates to cooling arrangements for shaft furnaces.

Known in the art is a cooling arrangement for blast furnaces (Japanese Patent Publication No. 45-14642, Nat. Cl. 10A521, published in 1970), comprising spaced apart metallic cooling tubes arranged so that with the cooling arrangement in position the tubes are adjacent to the furnace shell, are substantially parallel to its longitudinal generating line and are interconnected with metallic tie plates by welding, while the space between the cooling tubes and the tie plates interconnecting the same tubes is filled with a refractory material. In the prior art cooling arrangement, the cooling tubes extend along the height of the cooling zone of the furnace shaft and are interconnected by tie plates along both the height and the perimeter of the furnace shaft to thereby provide a rigid structure.

This structure is subjected to extreme thermal loads through the height and the perimeter of the furnace shaft. Under these conditions a rigid structure with the tubes interconnected as hereinabove described experiences considerable thermal stresses leading to breakaway of the tie plates from the cooling tubes and, consequently, to gas leakage through the cooling arrangement followed by overheating of the furnace shell resulting its warping and wreckage.

Moreover, due to the structural features the prior art cooling arrangement poses problems in its construction since a stringent observance of its design characteristics is required. Construction of the cooling arrangement is further complicated by the fact that this can be carried out in the furnace only during major repairs or in constructing the furnace to thereby extend the repair (construction) period and to make use of a special-purpose equipment at the construction site. Furthermore, it is to be appreciated that the cooling arrangement is assembled in a restricted space.

It is also to be kept in mind that making such long welds produces more stresses throughout the structure.

During a furnace run, the refractory material disintegrates and falls down to uncover the cooling tubes and therefore to increase heat losses, which result in an excessive consumption of fuel.

The uncovered tubes are exposed to an abrasive action of the dusty gases and the charge materials.

SUMMARY OF THE INVENTION

The invention is directed to the provision of a cooling arrangement for shaft furnaces, which is more adapted to construction and whose resistance to mechanical and thermal loads is increased by changing the interconnection between the cooling tubes to thereby offer a reliable protection for the furnace shell from the action of the furnace atmosphere.

The invention provides a cooling arrangement for shaft furnaces, comprising at least two spaced apart metallic cooling tubes arranged so that with the cooling arrangement in position they are adjacent to the furnace shell, are substantially parallel to its longitudinal generating line, and are interconnected with metallic tie plates by welding, while the space between the cooling tubes and the tie plates interconnecting the same tubes is filled with a refractory material. Further, each tie plate is tangentially welded to an adjacent tube of at least two cooling tubes with at least one edge portion along the generatrix of the tube surface on the shell side and between adjacent tie plates along the height of the cooling arrangement there is a spacing extending along the length of the tie plate laterally of the cooling arrangement, the latter being embraced along the perimeter thereof by a metallic frame having walls extending along the cooling tubes and slotted their entire width to compensate for heat expansion.

Such arrangement provides a more reliable protection for the furnace shell since this arrangement has an increased resistance to mechanical and thermal loads due to a novel interconnection between the cooling tubes which lies in the fact that each tie plate is tangentially welded to the tubes with at least one edge portion thereof and along the generatrix of the tube surface, while there is a spacing between the tie plates as well as spacings or slots in the frame walls. By virtue of these features the cooling arrangement has become less rigid, but its strength has increased because thermal stresses are compensated and the welding stresses heretofore developed in manufacture are nonexistent.

Such arrangement is also more adapted to construction inasmuch as the tie plates can be readily set out tangentially to the cooling tubes to be connected instead of setting them out in a diametric plane and the spacings between the tie plates naturally interrupt or discontinue the weld, which makes it easier to assemble the cooling arrangement even in the furnace.

It is to be noted that the cooling arrangement of the invention can be manufactured outside the furnace and then put up in position. This has become possible because the cooling tubes are embraced by a frame to provide a self-contained cooling element. It will be readily understood by those skilled in the art that such cooling elements may be of any dimensions depending on the application.

Various modifications may be made in the invention without departing from the spirit and scope thereof.

Thus, the second edge portion of each tie plate may be tangentially welded to an adjacent cooling tube on the shell side or the furnace side thereof as well as in the region defined by tangents to the circumference bounding the tube on its outer surface with the tangents originating frpom the location where at least one edge portion of each tie plate is welded.

Also, the tie plates may be provided with fins extending from the furnace side thereof to the interior of the furnace. The fins may be flat or bent toward a descending charge material.

It is suitable to provide fins extending laterally from the tubes and encompassing more than half their circumference from the furnace side thereof. Such fins may be horizontal, at an angle to the cooling tubes toward a descending charge material, and they may be bent toward a descending charge material. Such arrangement improves cooling of the refractory material and holding the lining slag with the remaining fragments of the refractory material after its possible disintegration, which reduces heat losses and, accordingly, saves fuel.

It is a good practice to space the fins apart from each other both on the cooling tubes and on the tie plates in order to compensate for thermal stresses.

According to a further aspect of the invention the cooling tubes may be provided with fins welded thereto along the generatrix in a spaced edge to edge relationship to compensate for heat expansion.

In this case the refractory material is cooled better.

The fins welded along the tube generatrix are preferably T-shaped like in cross-section. Such fins reduce destructible action of the charge materials on the refractory material and the cooling tubes as well as have a contributing effect on the wear resistance of the cooling arrangement as a whole.

The above features of the invention make possible the provisions of pins on the furnace side of the tie plates and of the fins, the latter may have the pins on both the furnace and the shell sides. The pins on the tie plates and on the fins provide for enhancing the cooling rate and, consequently, the durability of the cooling arrangement. Moreover, the pins are at least partially helpful in retaining of the refractory material that may disintegrate.

DETAILED DESCRIPTION OF THE INVENTION

Figure 1:
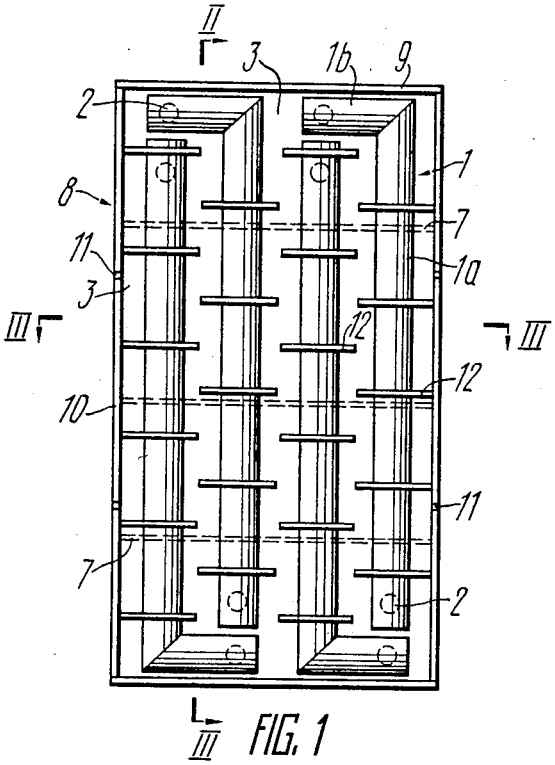
FIG. 1 is a front elevational view of the cooling arrangement without the refractory material.

FIG. 1 illustrates a cooling arrangement for cooling the shell of shaft furnaces, preferably blast furnaces. The front elevation shown herein is a cooling arrangement seen from the interior of the furnace or representing its furnace side and comprising steel cooling tubes 1 connected via the pipes 2 to a coolant source (not shown).

While FIG. 1 illustrates the cooling arrangement as having four cooling tubes 1, it may have two cooling tubes each of an L-shape configuration and including sections 1*a* and 1*b*, section 1*a* usually running vertically and section 1*b* horizontally. At least two such tubes forming an essentially closed rectangle provide for an effective protection of the furnace shell in the zone of the location of such cooling arrangement.

Also, the cooling tubes 1 as well as other metallic components may not necessarily be made of steel, as other metals or alloys suitable for specific thermal or chemical conditions of a specific furnace can be used.

The cooling tubes 1 are interconnected with steel tie plates 3. Each tie plate 3 has a first edge portion 4, which in this case is the edge of the tie plate, and a second edge portion 5, which is also the edge of the same tie plate but an opposite end. As cn be seen in FIG. 3 the edge portion 4 and the edge portion 5 of each tie plate 3 are tangentially welded to a corresponding adjacent cooling tube 1 along the generating line on the side facing the furnace shell 6 or the shell side of the tubes. The tie plates 3 are arranged so that there is a spacing 7 between adjacent tie plates along the height of the cooling arrangement, each spacing extending along the length of each tie plate laterally of the cooling arrangement. The cooling tubes 1 and the tie plates 3 assembled as herein described are embraced by a metallic frame 8 of a generally rectangular form and having horizontal 9 and vertical 10 walls. The walls 9 and 10 of the frame 8 are arranged with respect to the tubes 1 so that each wall extends along the respective tube 1 or the section thereof. In this exemplary cooling arrangement the vertical walls 9 extend along the sections 1*b*. The walls 9 are slotted as at 11 through their whole width.

Figure 2:
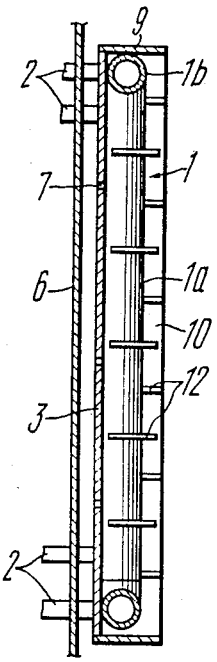
FIG. 2 is a sectional view taken along the line II—II in FIG. 1.
Figure 3:
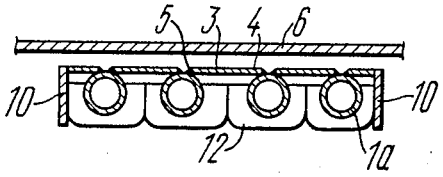
FIG. 3 is a sectional view taken along the line III—III in FIG. 1.

In the exemplary structure embodying the invention shown in FIGS. 1 through 3, the wall of the tube sections 1*a* and the vertical walls 10 are spaced apart and this space is bridged by the tie plates 3. The slots 11 as are provided between the spacings 7 but they may also coincide with the spacings 7, though this arrangement makes the structure less rigid. The cooling tubes 1, the tie plates 3, and the frame 8 form a receptacle to be filled with a refractory material such as refractory concrete. The cooling arrangement, assembled and filled with a refractory material, is a self-contained cooling element which can be built to desired dimensions and used as a part of a larger cooling system. The cooling arrangement may be assembled from such cooling elements, which were built outside the furnace, to thereby considerably facilitate both the manufacture of each individual element and the assembly of the whole cooling system. The space between the furnace shell 6 and the shell side of the cooling arrangement is filled by conventional methods.

Figure 4:
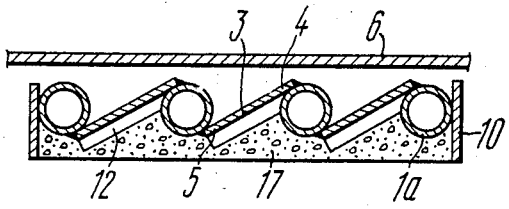
FIG. 4 is a sectional view illustrating an alternative embodiment of the cooling arrangement shown in FIG. 3.

According to an alternative embodiment shown in FIG. 4 the second edge portion 5 of each tie plate 3 is tangentially welded to a corresponding adjacent cooling tube 1 on the furnace side thereof. In this case the wall 10 may be welded to an adjacent cooling tube 1, namely the section 1*a* as can be seen in FIG. 4.

From the above description it follows that the second edge portion 5 may be welded to an adjacent cooling tube in the region defined by tangents to the circumference bounding the adjacent cooling tube on its outer surface, the tangents originating from the location where the first edge pontion 4 is welded to a corresponding tube 1, i.e., between the weld location on the shell side of the tube 1 (see FIG. 3) and the weld location on the furnace side of the tube 1 (see FIG. 4). If the first edge portion 4 is welded at the point of tangency then assembly of such a cooling arrangement will not be complicated.

According to another embodiment of the invention the tie plates 3 are provided with fins 12 on the furnace side thereof as illustrated in FIGS. 1–4. The fins 12 may also be provided on the cooling tubes 1 as is specifically shown in FIG. 1 or on the tie plates and the adjacent tubes as can be seen in FIG. 4.

Figure 5:
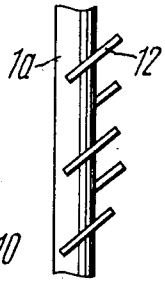
FIG. 5 is a sectional view illustrating a further version of the arrangement of the fins on the vertical wall as shown in FIG. 2.
Figure 6:
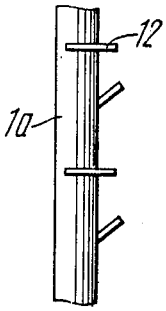
FIG. 6 is a sectional view illustrating another embodiment of the fin arrangement shown in FIGS. 2 and 5.

Referring to FIG. 3, the fins 12 are arranged laterally from the cooling tubes 1 and encompass more than half their circumference. The fins 12 are preferably arranged alternately in the vertical plane (FIG. 1), which arrangement provides for a more effective cooling of the refractory material while the cooling arrangement has a relatively low metal content. The fins 12 may be flat sheets horizontally extending into the interior of the furnace but within the thickness of the cooling arrangement (FIGS. 1 to 3). These fins may also be arranged at an angle to the cooling tubes 1 and directed toward the descending charge materials (FIG. 5) or they may form a combination of the above forms (FIG. 6).

Figure 7:
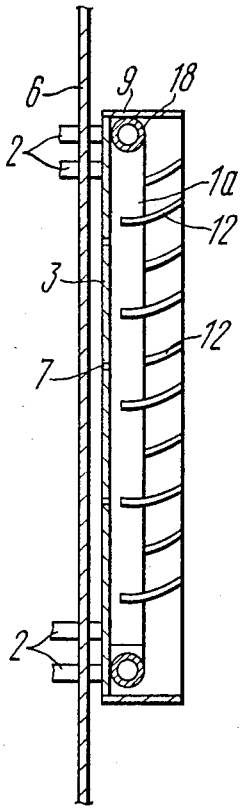
FIG. 7 is a sectional view illustrating another version of the fin arrangement as shown in FIGS. 2, 5 and 6.

A different form of the fins 12 is shown in FIG. 7 where the fins are bent toward the descending charge material.

Figure 8:
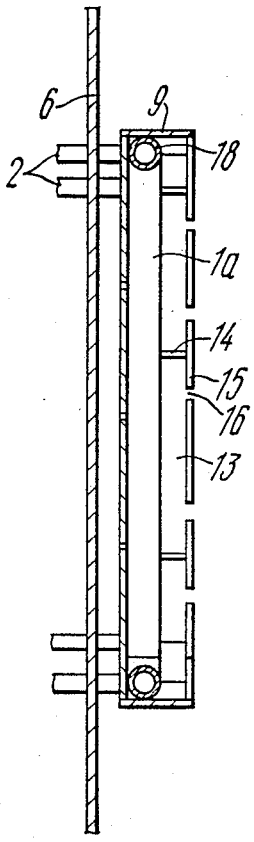
FIG. 8 is a sectional view showing another embodiment of the invention as shown in FIG. 2.

FIG. 8 illustrates an alternative embodiment of the invention wherein the cooling tubes 1 or their vertical portions 1*a* are provided with longitudinal fins 13 extending along the generatrix of the portions 1*a* and to the furnace interior. Each cooling tube 1 preferably has several fins 13 arranged so that there are spacings 14 between them to sompensate for thermal stresses or there may be on fin per tube which is slotted laterally of the tube at specific locations.

Figure 9:
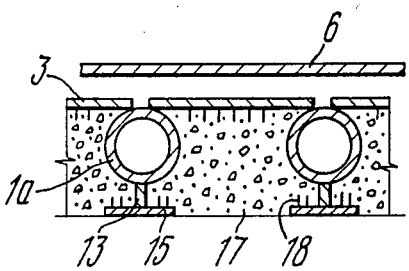
FIG. 9 is a cross-sectional view of another embodiment of the cooling arrangement as shown in FIGS. 3 and 4.
Figure 10:
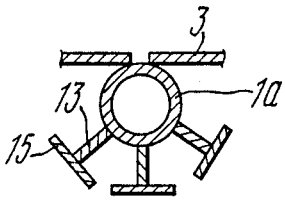
FIG. 10 is another version of the cooling arrangement as shown in FIG. 9.

As an alternative, the fins 13 are T-shaped in cross-section which is best seen in FIG. 9. In other words a flange 15 is welded to the fins or fin 13 and the flange may be slotted laterally or may be composed of several similar flanges arranged so that there is a spacing 16 between them (FIG. 8). The slots or spacings 16 may coincide with the spacings 14, or may not as in FIG. 8.

Referring to FIG. 9 where a fragment of a cooling arrangement of the invention is shown in cross-section, the cooling tubes 1 are connected by the tie plates 3 tangentially welded to the tubes 1 on the shell side thereof and the space between the tubes 1 is filled with a refractory material 17. Each cooling tube 1 has one fin 13 (or several such fins arranged in a spaced edge to edge relationship along the generatrix of the tube surface). The fins 13 are provided with flanges 15 having pins 18 extending from the shell side of the flanges. Also, similar pins may be provided on the furnace side of the tie plates 3 as is best seen in FIG. 9. Each tube 1 may also have several radially extending T-shaped fins or radial fins 13 with flanges 15.

In operation, the coolant flows through the inlet pipes 2 shown at the lower portion of the cooling arrangement (FIGS. 1 and 2) and into the cooling tubes 1 to take the heat from the refractory material 17 heated by the charge materials and the furnace gases. The heated coolant flows out of the cooling arrangement through the outlet pipes 2 shown at the upper portion of the cooling arrangement (FIGS. 1 and 2). The cooling tubes 1 are heated and therefore expand, but stresses do not develop in them due to the slots or spacings 7 between the tie plates 3 and due to the slots 11 in the walls of the frame 8. The fins 12 are, on the one hand, acting as reinforcing members for the refractory material, and on the other hand the fins 12 serve as a cooling means lowering the temperature of the refractory material and increasing its thermal stability (operative capacity).

The T-shaped fins 13 afford improved protection for the refractory material 17 from abrasion and diminish the area of contact of the refractory material with the charge and the furnace gases.

The fins 12 bent toward the descending charge material or arranged at an angle to the cooling pipes 1 provide for an improved holding of the lining slag and if the lining slag is not present they provide an improved holding of the components of the refractory material, which generally decreases abrasion of the cooling tubes 1 and improves operating capacity of the cooling arrangement. The pins 18 also serve as a reinforcing means for the refractory material and improve heat transfer from the same material.

INDUSTRIAL APPLICABILITY

The invention is useful is shaft furnaces, preferably blast furnaces.

We claim:

1. A cooling arrangement for shaft furnaces comprising:

(a) at least two spaced apart metallic cooling tubes arranged in the cooling arrangment in a position adjacent to a shell side of the shaft furnace, said cooling tubes substantially parallel to a longitudinal generating line of said shell side;

(b) at least two tie plates interconnecting said cooling tubes, each of said tie plates is tangentially welded to an adjacent tube of said cooling tubes with one edge portion of said tie plate along a generatrix of one surface of said adjacent tube of said cooling tubes on said shell side and said tie plates are adjacently arranged and separated by a spacing along a height of said cooling arrangement which extends laterally along a length of said tie plate;

(c) a refractory material filling a space between said cooling tubes and said tie plates; and (d) a metallic frame embracing a perimeter of said cooling arrangement having a vertical wall extending along said cooling tubes, said wall being slotted along an entire width to compensate for heat expansion.

2. A cooling arrangement according to claim 1, wherein each of said tie plates is comprised of a second edge portion tangentially welded to said adjacent cooling tube of said cooling tubes on said shell side.

3. A cooling arrangement according to claim 2, wherein said tie plates further comprise pins facing a furnace side of said shaft furnace.

4. A cooling arrangement according to claim 1, wherein said second portion of said tie plate is tangentially welded to a furnace side of said adjacent cooling tube of said cooling tubes.

5. A cooling arrangement according to claim 1, wherein said second edge portion of said tie plate is welded to said adjacent cooling tube in a region defined by a tangent to a circumference bounding said cooling tube on an outer surface, said tangent originating from a location where at least one of said first edge portion and said second edge portion of said tie plate is welded.

6. A cooling arrangement according to claim 4 or 5, wherein said tie plates have fins on a surface side.

7. A cooling arrangement according to claim 6, wherein said fins are bent toward a descending charge material.

8. A cooling arrangement according to claim 1, wherein said cooling tubes have fins extending laterally from said tubes, said fins encompassing more than half a circumference of said fins from said furnace side of said shaft furnace.

9. A cooling arrangement according to claim 8, wherein said fins extend horizontally from said cooling tubes.

10. A cooling arrangement according to claim 8, wherein said fins extend at an angle to said cooling tubes in a direction toward said descending charge material.

11. A cooling arrangement according to claim 8, wherein said fins are bent toward said descending charge material.

12. A cooling arrangement according to claim 1, wherein said fins of said cooling tubes are welded together along said generatrix of said surface of said adjacent tube of the cooling tubes in a spaced edge-to-edge relationship to compensate for heat expansion.

13. A cooling arrangement according to claim 12, wherein said fins of said cooling tubes appear T-shaped in cross-section.

14. A cooling arrangement according to claim 12, or 13, wherein said fins are provided with pins.

* * * * *